US005324184A

United States Patent [19]

Morey

[11] Patent Number: 5,324,184

[45] Date of Patent: Jun. 28, 1994

[54] AIR MOTOR PORTING SEALS

[75] Inventor: Kevin R. Morey, Laurinberg, N.C.

[73] Assignee: Ingersoll-Rand Company, Woodcliff Lake, N.J.

[21] Appl. No.: 48,220

[22] Filed: Apr. 20, 1993

[51] Int. Cl.[5] ..... F01C 19/00

[52] U.S. Cl. ..... 418/149; 418/255

[58] Field of Search ..... 418/104, 149, 255, 254, 418/253, 259, 260

[56] References Cited

U.S. PATENT DOCUMENTS

| | | | |
|---|---|---|---|
| 2,495,771 | 1/1950 | Richer | 418/255 |
| 2,922,376 | 1/1960 | Hankel et al. | 418/149 |
| 3,295,262 | 1/1967 | Brown | 418/149 |

*Primary Examiner*—Louis J. Casaregola
*Assistant Examiner*—Charles G. Freay
*Attorney, Agent, or Firm*—Walter C. Vliet

[57] ABSTRACT

A longitudinally extending seal is provided which provides circumferential sealing of a motor cylinder in a bore and further provides retention orientation and alignment for the motor cylinder and end plates within the motor housing.

5 Claims, 1 Drawing Sheet

AIR MOTOR PORTING SEALS

BACKGROUND OF THE INVENTION

This invention relates generally to pneumatically operated power tools and more particularly to a method for sealing an air motor that intakes and exhausts through its cylinder walls when assembled in a drafted or loose fit housing bore. Previous air motors of similar design are sealed by a close fit between the outside diameter of the motor and the diameter of the housing bore. This restricts the flow of air between the inlet and exhaust areas of the motor. Accurate dimensions on the outside diameter of the motor and the housing bore ID are required. To date, the only means of obtaining these tolerance requirements is to machine both dimensions in costly and time-consuming processes or by the use of compliant seals which are costly and difficult to assemble.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully discussed hereinafter.

SUMMARY OF THE INVENTION

In one aspect of the present invention this is accomplished by providing a porting and sealing means for a pressure fluid device comprising a housing having a longitudinally extending bore, a cylinder disposed within the bore with peripheral clearance space, port means circumferentially entering the peripheral clearance space, and a plurality of coacting longitudinally extending rib and slot means extending the length of the bore in contact with the cylinder and the bore for dividing the peripheral clearance space into distinct sealed chambers and retaining the orientation thereof on axial assembly of the cylinder within the bore.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
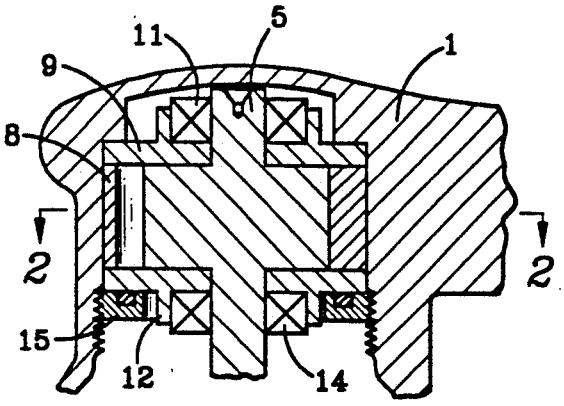
FIG. 1 (PRIOR ART)
FIG. 1 is a cross section of a vane type air motor according to the prior art taken at Section 1—1 of FIG. 2.

FIG. 1 shows a typical pneumatically operated vane motor installed in a power tool as, for example, a palm sander. The housing 1 is provided with a bore 4 for receiving a motor cylinder 8. The motor rotor 5 is installed within the cylinder 8 for rotation therewithin.

The rotor is provided with a plurality of motor vanes 6 which cooperate with the internal bore of the cylinder. The rotor 5 is oriented within the cylinder by means of a top end plate 9 and a bottom end plate 12 having a top bearing 11 and a bottom bearing 14 cooperating with the respective end plates and the rotor to both orient the rotor in an eccentric axis rotational position relative to the cylinder bore and to permit rotation of the rotor as is well-known in the prior art. The seal retainer 15 maintains the motor assembly within the housing bore.

Figure 2:
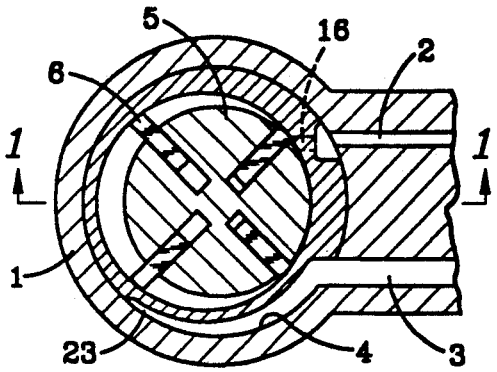
FIG. 2 (PRIOR ART)
FIG. 2 is a cross sectional view of a vane type air motor according to the prior art taken at Section 2—2 of FIG. 1.

Referring to FIG. 2, a pressure fluid is provided to the motor by means of an inlet port 2 and a motor inlet port 16. Pressure fluid exhausts the motor through a motor exhaust port 23 and a housing exhaust port 3. According to the prior art, both positioning of the motor cylinder and its end plates and the sealing between the inlet and the exhaust ports required close tolerances for both the bore and the outside diameter of the cylinder. In addition, there was no positive orientation of the cylinder within the housing.

Figure 3:
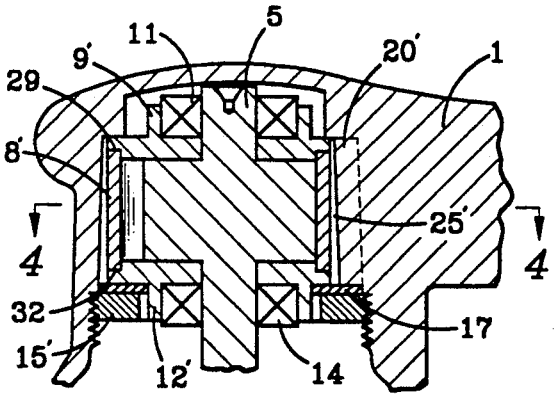
FIG. 3 is a cross section of a vane type air motor according to the present invention taken at Section 3—3 of FIG. 4.
Figure 4:
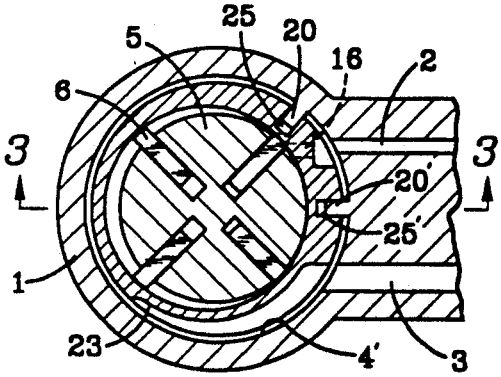
FIG. 4 is an air vane motor according to the present invention taken at Section 4—4 of FIG. 3.
Figure 5:
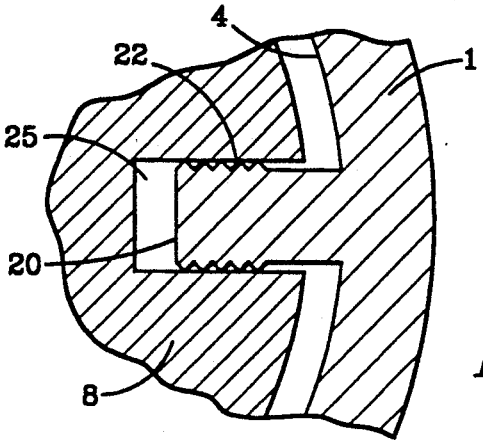
FIG. 5 is an enlarged cross section of a longitudinally extending rib seal according to the present invention taken from FIG. 4.

According to the present invention shown in FIGS. 3, 4, and 5, the housing and cylinder are provided with a pair of longitudinally extending ribs 20 and 20' and a pair of coacting slots 25 and 25' in the cylinder 8' and the end plates 9' and 12'. Upon assembly, the motor cylinder and its end plate are simply inserted longitudinally into the bore as oriented by the ribs 20 and 20'. A compliant seal 17 is held in place and thereby the motor retained in the bore 4 by means of a seal retainer 15'.

Referring to FIG. 4, the longitudinal ribs 20 and 20' provide a compartmented seal between the inlet port 2 and the exhaust port 3 from top to bottom of the housing bore 4. Effective sealing is, therefore, provided between the inlet port and the exhaust port by means of the ribs and the seal ridges 22 provided on the ribs 20 and 20' (as best seen in FIG. 5). It can be readily seen from FIG. 4 that the ribs also provide a means of rotational orientation for both the cylinder and the end plates within the bore and hence minimize the need for tight tolerance control between the motor cylinder exterior and the interior of the housing bore 4. This permits cast construction for the housing and the elimination of precision housing boring.

Concentric alignment of the end plates 9' and 12' with the motor cylinder 8' is accomplished by providing concentric circular lands 29 and 32 on each of the respective end plates. The circular lands cooperate with the circular bore of the cylinder 8' to provide the required concentric alignment.

It can also be appreciated that the circumferential positioning of the motor, and its end plates, in rotation relative to the housing is positively set thus assuring alignment of the ports and maximum motor performance.

What is claimed is:

1. A porting and sealing means for a pressure fluid device comprising:

a housing having a longitudinally extending bore, a cylinder disposed within said bore with peripheral clearance space, port means circumferentially entering said peripheral clearance space; a plurality of coacting longitudinally extending rib and slot means extending the length of said bore in contact with said cylinder and said bore for dividing said peripheral clearance space into distinct sealed chambers and retaining the orientation thereof on axial assembly of said cylinder within said bore and said ribs are provided with an additional seal means between said ribs and said slots.

2. A porting and sealing means for a pressure fluid device according to claim 1, wherein said pressure fluid device comprises a palm sander.

3. A porting and sealing means for a pressure fluid device according to claim 1, wherein said longitudinally extending ribs are provided on said bore and said slot means are provided in said cylinder.

4. A porting and sealing means for a pressure fluid device according to claim 1, wherein said cylinder is retained within said bore by means of a compliant seal and a seal retainer.

5. A porting and sealing means for a pressure fluid device comprising:

a housing having a longitudinally extending bore, a cylinder disposed within said bore with peripheral clearance space, port means circumferentially entering said peripheral clearance space; a plurality of coacting longitudinally extending rib and slot means extending the length of said bore in contact with said cylinder and said bore for dividing said peripheral clearance space into distinct sealed chambers and retaining the orientation thereof on axial assembly of said cylinder within said bore; and said cylinder is provided with a pair of opposed end plates which are further oriented by said plurality of coacting longitudinally extended ribs and slots means.

* * * * *